US006035670A

United States Patent [19]

Park

[11] Patent Number: 6,035,670

[45] Date of Patent: Mar. 14, 2000

[54] CLOTHES WASHER HAVING A COMPRESSED WATER GENERATION APPARATUS

[75] Inventor: Kwan-Choul Park, Kwangju, Rep. of Korea

[73] Assignee: Daewoo Electronics Co., Ltd., Seoul, Rep. of Korea

[21] Appl. No.: 09/069,829

[22] Filed: Apr. 30, 1998

[30] Foreign Application Priority Data

Apr. 30, 1997 [KR] Rep. of Korea ..... 97-16751

[51] Int. Cl.[7] ..... D06F 17/02; D06F 17/06

[52] U.S. Cl. ..... 68/23.7; 68/53; 68/184

[58] Field of Search ..... 68/23.6, 23.7, 68/53, 131, 133, 134, 184

[56] References Cited

U.S. PATENT DOCUMENTS 4,134,277 1/1979 Platt et al. ..... 68/53

4,306,841 12/1981 Morrison et al. ..... 68/184 X 5,746,071 5/1998 Youn ..... 68/184 X

*Primary Examiner*—Philip R. Coe

*Attorney, Agent, or Firm*—Jacobson, Price, Holman & Stern, PLLC

[57] ABSTRACT

A compressed water generation apparatus of clothes washer comprises a hollow body, a piston housed in the hollow body, a valve for allowing the water through an inlet opening formed at an upper portion of the hollow body in response to a movement of the piston, and a flexible band connecting to the housing by one end thereof and to the piston by another end thereof, for expanding volume of space created between the inlet opening of the hollow body and the piston in respect to the movement of the water basket, thus drawing in the water of the water basket, compressing the water, and discharging the pressurized water toward the clothes basket.

5 Claims, 4 Drawing Sheets

CLOTHES WASHER HAVING A COMPRESSED WATER GENERATION APPARATUS

BACKGROUND OF THE INVENTION

1. Field of the Invention

The present invention relates to a clothes washer, and more particularly to a clothes washer having a compressed water generation apparatus in which water is compressed and discharged in response to vibration energy of a water basket 2. Description of the Prior Art Generally, a clothes washer is operated by predetermined modes, e.g., a water supplying mode for supplying water to a clothes basket, a clothes washing mode for washing clothes by water supplied in the water supplying mode, a rinsing mode for rinsing clothes after completion of the clothes washing mode, and a dehydrating mode for dehydrating the clean clothes after the rinsing mode.

FIG. 5 illustrates the typical clothes washer which is operated by a series of modes. A water basket 11 for housing an amount of water is provided in a rectangular housing 10. The water basket 11 is shaped as a hollow cylinder for preventing the interruption of swirling water during the clothes washing mode, and is suspended in the housing via a suspension rod 16.

That is, a damper 17*a* is provided at each of four spots of the bottom portion of circumferential outer surface of the water basket 11. Each damper 16*a* is connected to one lower end of a suspension rod 16, while the other upper end of the suspension rod 16 is connected in suspension to a bracket (not shown) which is mounted at an upper portion of inner surface of the housing 10.

Moreover, the cylindrical clothes basket 12 is rotatably disposed in the water basket 11. The clothes basket 12 has plural openings 12*a* through which the water supplied into the clothes basket 12 flows toward the water basket 11. Thus, the water level of the clothes basket 12 is the same as that of the water basket 11. Dirty water is dehydrated from the water absorbing clothes during the dehydrating mode, and lint flows through the openings to the water basket 11.

Moreover, a weight balancer (not shown) is provided at the circumference of an upper rim of the clothes basket 12 to reduce the vibration of the clothes basket 12 during the dehydrating mode.

The pulsator 13 is provided at the inner bottom of the clothes basket 12 to be rotated in clockwise and counter-clockwise directions. The water supplied in the clothes basket 12 is shaken causing the clothes to be rubbed together, thus executing a washing operation.

A reduction gear assembly 15 is provided beneath the water basket 11 and has a washing shaft 15*a* and a dehydrating shaft 15*b* on the upper portion of the gear assembly 15. The washing shaft 15*a* is connected with the pulsator 13, while the dehydrating shaft 15*b* is attached to the bottom portion of the clothes basket 12. The reduction gear assembly 15 is rotated in clockwise and counter-clockwise directions by the rotation of the motor 14 attached on the bottom of the water basket 11.

In the clothes washer provided as above, clothes are loaded in the water basket 12 and water is supplied into the water basket 12, proceeding with the washing mode. That is, when the motor 14 is rotated bi-directionally at the washing mode, the rotational force of the motor is transferred to the reduction gear assembly 15. The speed reduced rotational force is transferred to the pulsator 13 through the washing shaft 15*a*. The bi-directional rotation of the pulsator 13 causes swirling of the water, and the clothes are rubbed together by the swirling water to proceed with the washing operation.

In other words, when the planar pulsator 13 is rotated, plural wings radially formed on the upper surface of the pulsator 13 enable the water to be swirled. During the rotation of the pulsator, the clothes are rubbed together by the rotating water stream.

Further, when the pulsator 13 is rotated bi-directionally during the washing mode, vibration occurs in the water basket 12 due to the rotation of the clothes basket 11 and the swirling of the washing water. Since the water basket 11 is elastically suspended in the housing via the suspension rod 16, the vibration is reduced.

After the completion of the washing mode and draining of the water, the dehydrating mode proceeds. When the motor 14 is rotated at a high speed in one direction during the dehydrating mode, the dehydrating shaft 15*b* is rotated at a high speed by the switching of the driving force transmission route, thus rotating the clothes basket 12 at a high speed.

The centrifugal force is applied to the clothes by the high speed rotation of the clothes basket 12. The clothes spread out on the inner surface of the clothes basket 12, and the water absorbed in the clothes is dehydrated. The spun-away water is discharged to the water basket 11 through plural openings 12*a* formed at the clothes basket 12. The discharged water is drained through the drain pipe (not shown).

However, in the conventional clothes washer, the washing process proceeds utilizing the swirling water generated during the bi-directional rotation of the pulsator 13. The clothes which gather in the center of the clothes basket are twisted and tangled. This causes inefficient washing in respect of the clothes and thus poor efficiency of the washing. That is, the rotational water stream occurs, and the clothes are rotated by the water stream. During this operation, the clothes are rubbed together, and the washing proceeds. The swirling water gathers the clothes in the center of the clothes basket, and the clothes are twisted and tangled. The twisted and tangled clothes cannot rub together easily. Thus, washability is greatly reduced, and the washing time is also lengthened.

Furthermore, the long washing time enables the motor 5 and the reduction gear assembly 6 to overload so the life of the clothes washer is shortened. Moreover, since only a continual water stream generated by the pulsator 13 is utilized during the washing process, the efficiency of the washing is reduced.

Furthermore, vibration energy of the water basket 11 created during the washing mode is dampened at the suspension rod, thus being wasted as unnecessary energy.

SUMMARY OF THE INVENTION

Therefore, it is an object of the present invention to provide a clothes washer having a compressed water discharge apparatus for improving the washing efficiency of the washer.

It is another object of the present invention to provide a clothes washer having a compressed water discharge apparatus for performing high efficiency washing without damage to the clothes.

It is another object of the present invention to provide a clothes washer having a compressed water discharge apparatus for utilizing vibration energy of the water basket during the washing mode.

In order to achieve the above objects of the present invention, a clothes washer having a compressed water generation apparatus comprises a housing, a water basket disposed in the housing for containing water, a clothes basket disposed in the water basket, a pulsator disposed in the clothes basket, a driving force selecting means which is disposed between the housing and the water basket and selectively transmits a driving force of a motor to the clothes basket and the pulsator, and a compressed water discharge generation apparatus for drawing in the water of the water basket, compressing the water, and discharging the water toward the clothes basket.

Further, the compressed water generation apparatus releases the compressed water in response to an upward and downward movement of the water basket.

Furthermore, the compressed water generation apparatus comprises a hollow body, a piston housed in the hollow body, a valve for allowing water through an inlet opening formed at an upper portion of the hollow body in response to a movement of the piston, and a flexible band connecting to the housing by one end thereof and to the piston by another end thereof, for expanding volume of space created between the inlet opening of the hollow body and the piston in respect to the movement of the water basket.

Further, the compressed water generation apparatus further comprises a first outlet opening formed at the lower portion of the wall of the hollow body, through which the compressed water contained in space created between a bottom portion of the hollow body and the piston is discharged toward the clothes basket.

Alternatively, the compressed water generation apparatus further comprises a compression spring for enabling the valve to block the inlet opening and pushing the piston to compress the water contained in the space.

Furthermore, the compressed water generation apparatus further comprises a second outlet opening formed at the upper portion of the wall of the hollow body, through which the compressed water contained in the space created between the inlet opening of the hollow body and the piston.

BRIEF DESCRIPTION OF THE DRAWINGS

The above objects and other advantages of the present invention will be more clarified by describing a preferred embodiment thereof with reference to the accompanying drawings in which.

DESCRIPTION OF THE PREFERRED EMBODIMENT

Hereafter, the invention will be described in further detail with reference to the accompanying drawings.

Figure 1:
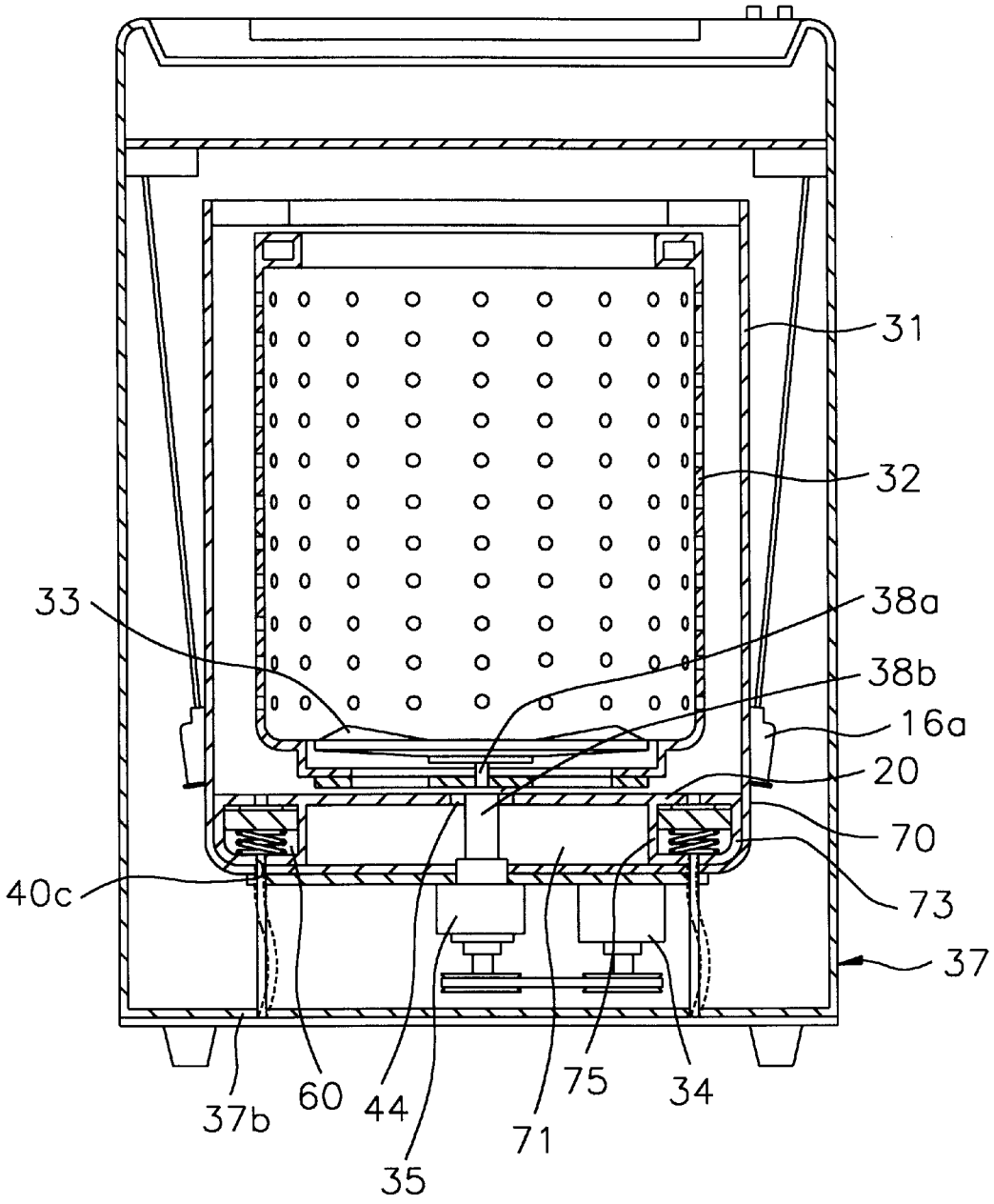
FIG. 1 is a vertical elevational view of a clothes washer having a compressed water generation apparatus in accordance with the present invention.
Figure 2:
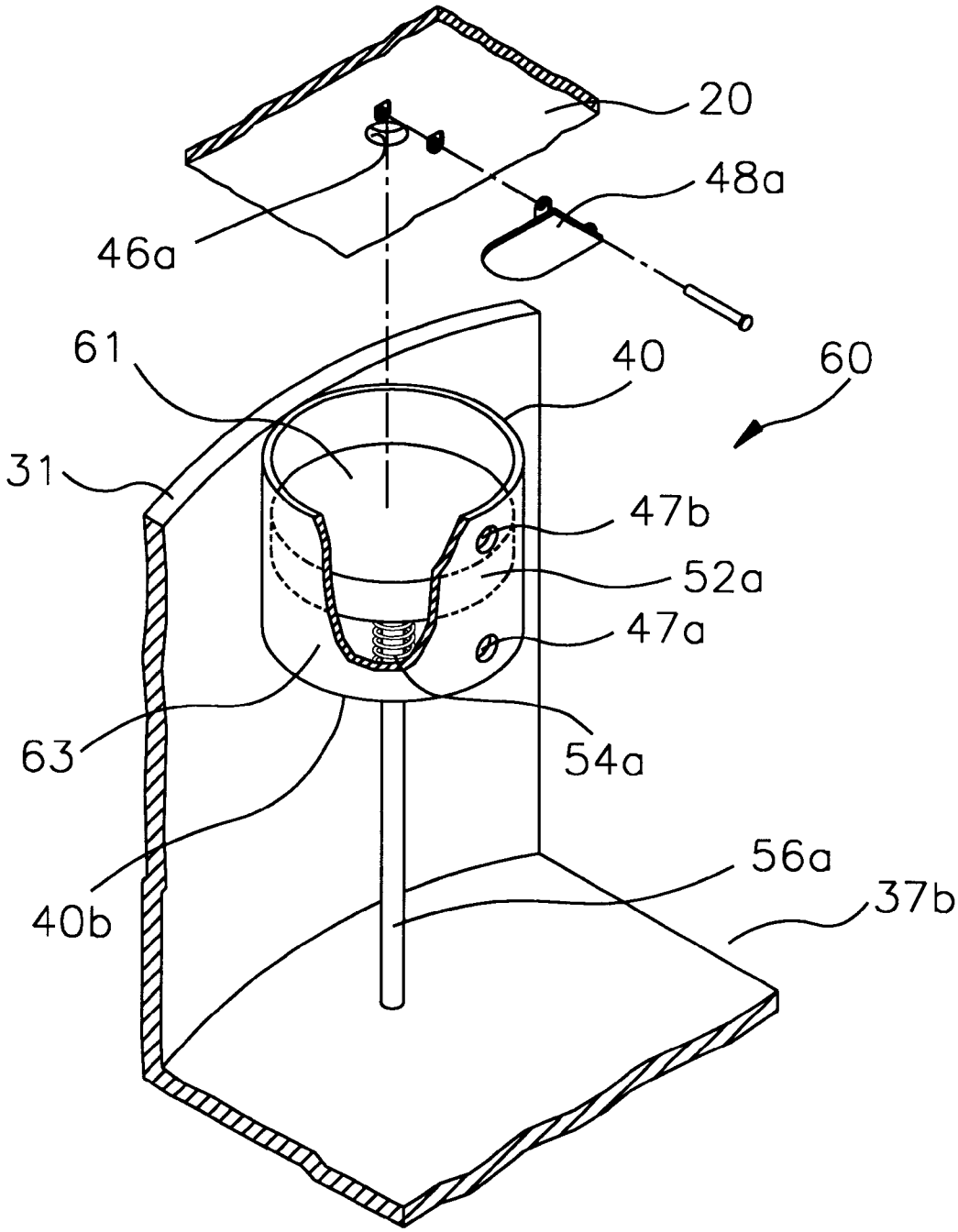
FIG. 2 is an enlarged broken-away perspective view of the compressed water generation apparatus in FIG. 1.

FIGS. 1 and 2 illustrate a clothes washer of the present invention. The clothes washer comprises a housing 37, a water basket 31 disposed in the housing 37 for containing water, a clothes basket 32 disposed in the water basket 31 and providing a chamber 70 at a bottom portion in which the chamber 70 is partitioned by a horizontal plate 20, and a pulsator 33 disposed in the clothes basket 32.

Further, the clothes washer comprises a reduction gear assembly 35 which is disposed between the housing 37 and the water basket 31 and selectively transmits a driving force to the clothes basket 32 and the pulsator 33.

The chamber 70 comprises an intermediate chamber 71 and a circumferential chamber 73 which are separated by a partition wall 75. A dehydrating shaft 38*b* is provided through the intermediate chamber 71 to be attached to the bottom portion of the clothes basket 32 by which the driving force of a motor 34 is transferred to the pulsator 33 through the reduction gear assembly 35. A washing shaft 38*a* is connected to the pulsator 33. The circumferential chamber 73 houses a compressed water generation apparatus 60 for drawing in water of the water basket 31, compressing the water, and discharging the water toward the clothes basket 31.

The compressed water generation apparatus 60 comprises a hollow body 40, a piston 52*a* housed in the hollow body 40, a valve 48*a* for allowing the water through an inlet opening 46*a* formed at an upper portion of the hollow body 40, i.e., at the horizontal plate 20, a flexible band 56*a* connecting to a bottom portion 37*b* of the housing 37 by one end thereof and to the piston 52*a* by another end thereof, and a compression spring 54*a* for enabling the valve 48*a* to block the inlet opening 46*a* and pushing the piston 52*a* toward upper space 61 created by the horizontal plate 20 and the piston 52*a*. The flexible band 56*a* penetrates through an opening 40*c* which is formed at the bottom portion 40*b* of the hollow body 40. A rubber bushing may be installed inside of the opening 40*c* to prevent the water in the hollow body 40 from leaking through the opening 40*c*.

Further, a first outlet opening 47*a* is provided at the lower portion of the wall of the hollow body 40 which surrounds lower space 63 created between the piston 52*a* and the bottom portion 40*b* of the hollow body 40. Furthermore, a second outlet opening 47*b* is provided at the upper portion of the wall of the hollow body 40 which surrounds upper space 61 created between the piston 52*a* and the horizontal plate 20.

Two compressed water generation apparatus 60 are illustrated in FIG. 1, but more than two are employed, if necessary.

The clothes washer according to the present invention constructed as above is operated as below.

The washing mode starts according to a predetermined program, then the operating force of the motor 34 is transmitted to the reduction gear assembly 35. In the reduction gear assembly 35, the washing shaft 38*a* rotates the pulsator 33 in clockwise and counter-clockwise directions to clean the clothes housed in the washing basket 32. Vibration of the motor 34 and the reduction gear assembly 35 transfers to the water basket 31 during the washing mode. Vibration is dampened by the damper 16*a* connected to the water basket 31. The water basket 31 moves in up and down directions during the dampening operation of the damper 16*a*.

Figure 3:
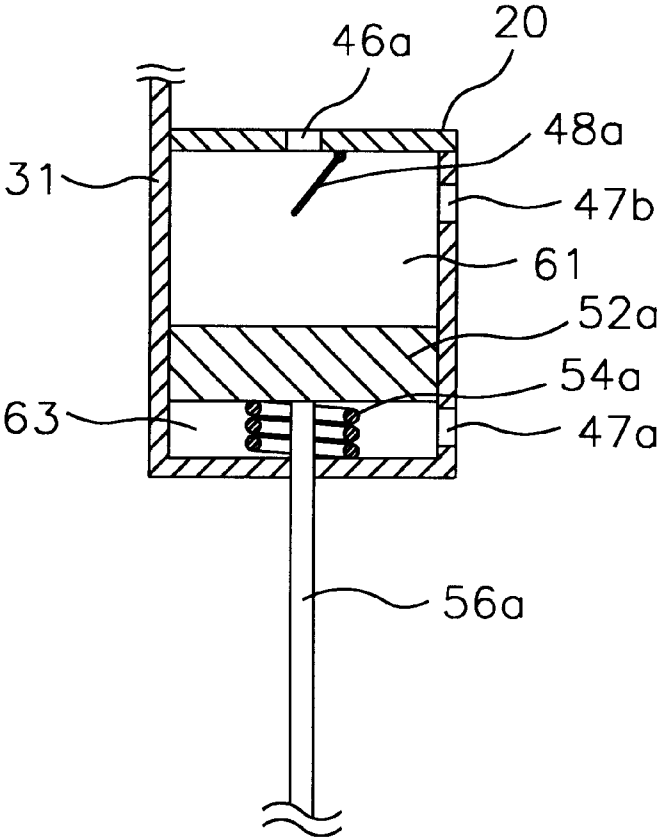
FIG. 3 is a vertical elevational view of the compressed water generation apparatus when the water basket is moved upward.
Figure 5:
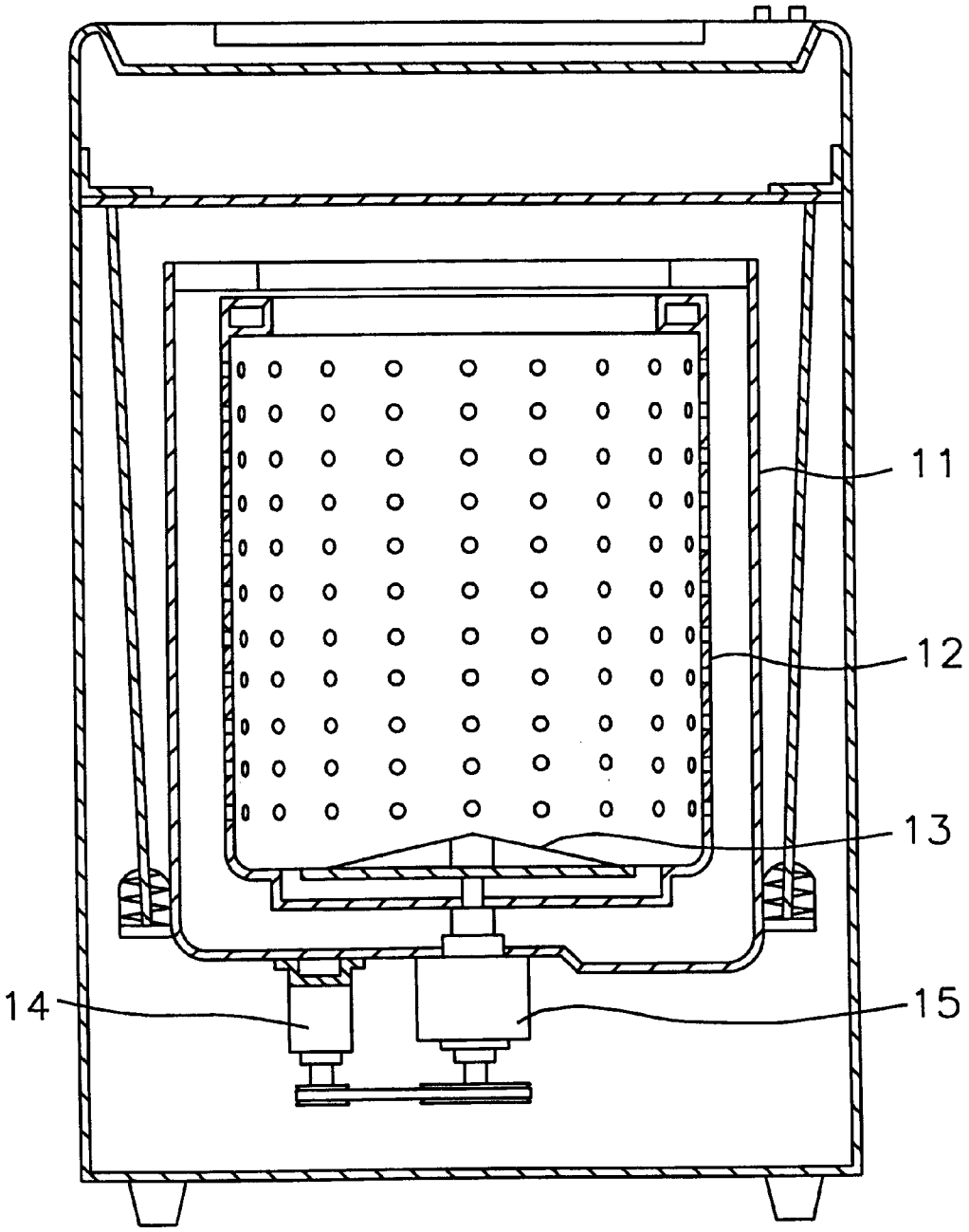
FIG.5 PRIOR ART
FIG. 5 is a vertical elevational view of the clothes washer in accordance with a prior art.

In the upward movement of the water basket 31 as shown in FIG. 3, the compressed water generation apparatus 60 is lifted up and thus the wall of the hollow body 40 moves upward. The piston 52*a* is in the static position because the flexible band 56*a* which is fixed by one end of the band to the bottom portion 37*b* of the housing 37 pulls down the piston 52*a* by the tension state of the band 56*a*, accompanying the compressing spring 54*a*. The lower space 63 gradually decreases to push the water contained in the lower space 63 to flow out through the first outlet opening 47*a*. Simultaneously, the upper space 61 gradually increases to draw the water of the water basket 31 into the space 61. One free end of the valve 48*a* moves away from the inlet opening 46*a* along the downward movement of the piston 52*a*, thus inducing the opening of the inlet opening 46*a* which was blocked by the valve 48*a*.

Figure 4:
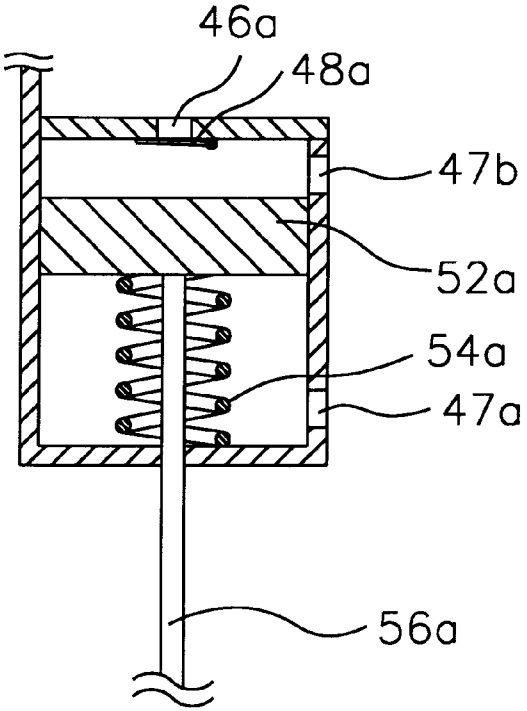
FIG. 4 is a vertical elevational view of the compressed water generation apparatus when the water basket is moved downward.

To the contrary, the compressed water generation apparatus 60 moves downward along the downward movement of the water basket 31 as shown FIG. 4. The tension state of the band 56*a* is released by the downward movement of the hollow body 40. The piston 52*a* is moved up owing to the expansion force of the spring 54*a* which was compressed during the upward movement of the hollow body 40. Thus, the valve 48*a* blocks the inlet opening 46*a*. The water contained in the upper space 61 is pressurized due to the gradual decrease of volume of the upper space 61. The pressurized water flows through the second outlet opening 47*b*, and through the intermediate chamber 71. Next, the pressured water is discharged to the clothes basket 32 through the opening 44 formed adjacent to the dehydrating shaft 38*b*.

The water basket is moved up and down continuously and repeatedly by vibration of the motor during the washing mode.

According to the present invention as described above, the apparatus utilizing energy generated by vibration of the motor is provided at the bottom portion of the water basket. The vibration of the motor induces the up and down movement of the water basket. The upward movement of the water basket increases volume of the space created by the upper portion of the hollow body and the piston, thus inducing the space to have negative pressure. The water is drawn into the space. On the contrary, the downward movement of the water basket induces the upward movement of the piston, and thus the flap valve blocks the water inlet of the hollow body. The water contained the space is pressurized. The pressurized water is spouted to the clothes, thus achieving high efficiency washing by the strong swirling water. The apparatus can use vibration which can be regarded as waste energy.

What is claimed:

1. A clothes washer having a compressed water generation apparatus comprising:

a housing;

a water basket disposed in the housing for containing water;

a clothes basket disposed in the water basket;

a pulsator disposed in the clothes basket;

a reduction gear assembly which is disposed between the housing and the water basket and selectively transmits a driving force of a motor to the clothes basket and the pulsator; and a compressed water generation apparatus for drawing in the water of the water basket, compressing the water, and discharging the water toward the clothes basket, the compressed water generation apparatus including a hollow body, a piston housed in the hollow body, a valve for allowing the water through an inlet opening formed at an upper portion of the hollow body in response to a movement of the piston, and a flexible band connecting to the housing by one end thereof and to the piston by another end thereof, for expanding volume of space created between the inlet opening of the hollow body and the piston in respect to the movement of the water basket.

2. The clothes washer in accordance with claim 1, wherein the compressed water generation apparatus releases the compressed water in response to an up and down movement of the water basket.

3. The clothes washer in accordance with claim 2, wherein the compressed water generation apparatus further comprises a first outlet opening formed at the lower portion of the wall of the hollow body, through which the compressed water contained in space created between a bottom portion of the hollow body and the piston is discharged toward the clothes basket.

4. The clothes washer in accordance with claim 2, wherein the compressed water generation apparatus further comprises a compression spring for enabling the valve to block the inlet opening and pushing the piston to compress the water contained in the space.

5. The clothes washer in accordance with claim 4, wherein the compressed water generation apparatus further comprises a second outlet opening formed at the upper portion of the wall of the hollow body, through which the compressed water contained in the space created between the inlet opening of the hollow body and the piston flows out.

* * * * *